United States Patent [19]

Pierlot

[11] B 4,008,700

[45] Feb. 22, 1977

[54] FUEL FEED DEVICE FOR INTERNAL COMBUSTION ENGINE

[75] Inventor: Michel Pierlot, Le Pecq, France

[73] Assignee: Societe Industrielle de Brevets et d'Etudes S.I.B.E., France

[22] Filed: June 17, 1974

[21] Appl. No.: 480,251

[44] Published under the second Trial Voluntary Protest Program on March 23, 1976 as document No. B 480,251.

[30] Foreign Application Priority Data

Aug. 1, 1973 France ..... 73.28200

[52] U.S. Cl. ..... 123/139 AW; 123/119 R; 123/139 BG

[51] Int. Cl.[2] ..... F02M 39/00

[58] Field of Search ..... 123/139 AW, 139 BG, 123/119 R; 261/50 A

[56] References Cited

UNITED STATES PATENTS

| | | | |
|---|---|---|---|
| 3,286,998 | 11/1966 | Mennesson | 123/139 AW |
| 3,288,445 | 11/1966 | Mennesson | 123/139 AW |
| 3,404,667 | 10/1968 | Mennesson | 123/139 AW |
| 3,703,888 | 11/1972 | Eckert | 123/139 AW |
| 3,782,339 | 1/1974 | Scholl | 123/139 AW |
| 3,834,679 | 9/1974 | Baribeau | 123/139 AW |
| 3,842,813 | 10/1974 | Eckert | 123/139 AW |

FOREIGN PATENTS OR APPLICATIONS

| | | | |
|---|---|---|---|
| 2,032,021 | 11/1970 | France | 123/139 AW |
| 1,309,918 | 10/1962 | France | 123/139 AW |

*Primary Examiner*—Charles J. Myhre
*Assistant Examiner*—Daniel J. O'Connor
*Attorney, Agent, or Firm*—Stevens, Davis, Miller & Mosher

[57] ABSTRACT

In a fuel feed device for internal combustion engine, the fuel is injected at a rate which is metered responsive to the opening of an auxiliary throttle member located upstream of the driver actuated main throttle member in the intake pipe. For air flow damping purpose, an air filter chamber is located between the auxiliary and main throttle members.

5 Claims, 1 Drawing Figure

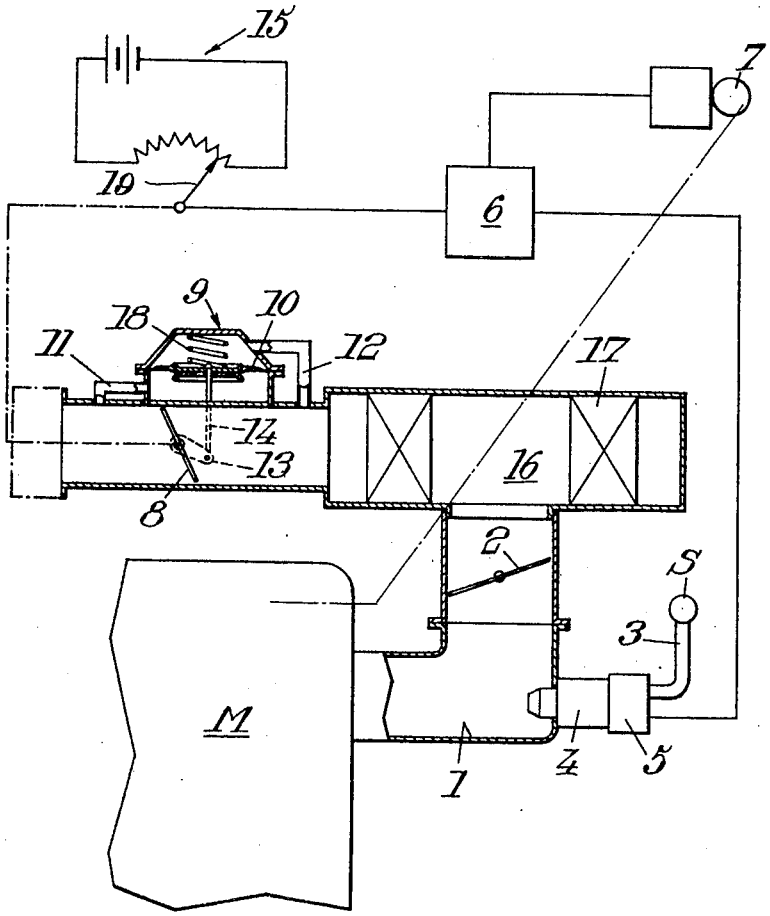
15
7
19
6
9
10
18
11
12
17
14
13
16
8
2
S
3
M
1
4
5

FUEL FEED DEVICE FOR INTERNAL COMBUSTION ENGINE

The invention relates to fuel feed devices for internal combustion engines of the type which comprise: in their intake pipe, a main throttle member actuated by the driver; a source of fuel under pressure whose delivery circuit, which open into a portion of the intake pipe situated downstream of the main throttle member, is controlled by at least one valve actuated by an electro-magnet; and a metering system which is adapted to send into the electro-magnet, on each revolution of a rotary member, an energising signal the duration of which varies in the same sense as the degree of opening of an auxiliary throttle member which is located in the intake pipe upstream of the main throttle member and which is arranged to open gradually, in proportion as the flow-rate of air increases in said pipe.

A device of the above type is described in French patent no. 2,032,021. This device gives general satisfaction, in that it constitutes a very distinct improvement with respect to prior systems, but the accuracy of its operation at full load may be detrimentally affected by the pulsatory nature of the flow-rate of air drawn in by the engine. More precisely, the quantity of fuel supplied by the above-defined device is fixed by the position of the auxiliary throttle member. Consequently, the exactness of metering is only ensured if the position of the auxiliary throttle member correctly reflects the average flow-rate of air which passes in the intake pipe. Now, when the engine operates at full load, the main throttle member is largely open and the auxiliary throttle member tends to follow the momentary variations of the highly pulsed flow of air drawn in by the engine and it tends to take up an oscillatory movement which renders the metering of the amount of fuel injected into the engine inaccurate. It might be thought that it suffices to dampen the movement of the auxiliary throttle member (for example by means of a dash-pot) to avoid this deficiency. In fact, the auxiliary throttle member, if damped, tends, as a result of the pulsations of the flow of air, to take up an open position which corresponds to a higher flow-rate of air than the average flow-rate actually drawn in by the engine. Consequently, the amount of fuel supplied to the engine is adjusted to a higher value than what it should be.

It is an object of the invention to provide a supply device of the above-defined type which is improved with respect to prior art devices, especially in that it is, to a large extent, free of the above drawbacks.

To this end, the invention provides a supply device which comprises an air filter chamber arranged in the intake pipe of the engine, downstream of the auxiliary throttle member and upstream of the principal throttle member.

The additional space provided by the chamber damps the oscillations of the flow of air. The damping of the oscillations is further increased by the presence of the filter element which imposes on the airflow which traverses it a head loss which is a highly increasing function of the momentary or instantaneous flow-rate.

The chamber typically locates a filter element which is the only air filter of the engine, so that there is no need for a supplementary element. It is also possible to provide, in addition to the air filter arranged in the damper space, a rudimentary or simplified additional air filter, placed upstream of the auxiliary throttle member, although the latter construction is generally not preferred.

The invention will be better understood from the following description of a particular embodiment of the invention, given by way of non-limitative example. The description refers to the single FIGURE which accompanies it and shows, diagrammatically, an engine provided with a device according to the invention.

The device comprises, associated with the engine M:

in the intake pipe 1, a main throttle member 2 (butterfly valve controlled by the accelerator pedal or treadle);

a source S of fuel under pressure whose delivery circuit 3, which opens into the portion of the intake pipe 1 situated downstream of the main throttle member 2, is controlled by at least one valve 4 actuated by an electro-magnet 5; there may be provided either a valve per cylinder of the engine, or a valve for the whole of the engine;

a metering system which comprises a rotary member 7, typically driven by the engine M, supplying on each revolution a triggering signal. This rotary member is operatively associated with a fixed member to provide periodic triggering signals to an electrical rectangular pulse generator 6 which controls the electro-magnet 5.

Referring to the single FIGURE, the supply device comprises also an auxiliary throttle member 8, constituted by a butterfly valve situated in the pipe 1 upstream of the main throttle member 2. This auxiliary throttle member is adapted to open automatically and progressively when the flow-rate of air sucked in by the engine increases. To this end, it is associated with a control capsule 9 which comprises a diaphragm 10 subject, on one side, to the pressure which exists upstream of the auxiliary throttle member, communicated through a passage 11 and, on the other side, to the pressure which exists downstream, communicated through a passage 12. The auxiliary throttle member 8 is connected to the diaphragm 10 by a linkage comprising a lever 13 and a rod 14. A return spring 18 opposes the pressure differential acting on the diaphragm 10 and biases the auxiliary throttle member 8 to its closed position.

The auxiliary throttle member could as well consist of a member other than a butterfly valve, and for instance of a simple excentrically mounted flap-valve which the suction created by the flow tends to open and which a return spring tends to close, of an obturating piston, etc . . . .

The device comprises also an impedance, constituted here by a variable resistor 15, associated with a voltage source to form a potentiometer, the slider 19 of which is mechanically coupled to the auxiliary throttle member 8.

The voltage signal supplied by the potentiometer 15 is delivered to the electrical pulse generator 6 which may be of a type old in the art and consist of electrical circuits (such as univibrator and power amplifying circuits), the "set" time of the univibrator depending on the value of the resistance 15.

The device described until now is of known type and it may be constituted as described in French Pat. No. 2,032,021, so that a full description is unnecessary.

The operation of the device is as follows. When the engine is running and sucks in a given flow-rate of air through the pipe 1, there appears between the upstream and downstream of the auxiliary throttle member 8, a pressure difference which acts on the diaphragm 10 of the capsule 9, tends to open the member 8 and to reduce the pressure difference. The throttle member 8 then takes up a position representative of the flow-rate of air which passes in the pipe 1. The throttle member adjusts the potentiometer 15 which supplies the pulse generator with a reference signal serving to determine the duration of the pulses emitted on each revolution of the rotary member 7.

The illustrated device comprises, to eliminate the effect of pulsations of the flow drawn in by the engine, a chamber 16 provided in the pipe 1 downstream of the auxiliary throttle member 8 (and of the opening of the passage 12) and upstream of the principal throttle member 2. This chamber 16 constitutes a space which advantageously contains a filtering element 17. That filtering element typically constitutes with the chamber the single air filter of the engine, although a reduced supplementary air filter may be retained and located upstream of the member 8. The size of the space in the chamber 16 may be selected so as to produce optimal damping of the oscillations; but, as a general rule, the size necessary to house a conventional filtering element is satisfactory.

The pulsations being damped in the chamber space 16, the flow-rate of air, at the location of the auxiliary throttle member 8, is practically uniform and member 8 takes up a stable and precise position which is a univocal function of the flow-rate of the air which passes through it, independent of the fluctuations downstream of the space 16 and fully representative of the average actual flow-rate of air sucked in by the engine. The electrical signal provided by the potentiometer 15 is thus rendered correct at all speeds of the engine and the flow-rate of fuel injection may be metered to a value such that the richness of the air-fuel mixture supplied to the engine is suitable.

I claim:

1. A fuel feed apparatus for internal combustion engines, comprising: an intake pipe; a main throttle member located in said intake pipe; an auxiliary throttle member located in said intake pipe upstream of said main throttle member; means for progressively opening said auxiliary throttle member proportionally as the flow rate of air in said intake pipe increases; a source of fuel under pressure; a fuel supply circuit coupled to said fuel source and said intake pipe and opening into said pipe downstream of said main throttle member, said supply circuit including at least one solenoid valve for controlling the supply of fuel from said source into said pipe; a metering system coupled to said solenoid valve and to said auxiliary throttle member for providing energizing signals to said solenoid valve, the duration of said signals in a given time period varying proportionally with the amount of opening of said auxiliary throttle member; a chamber located in said intake pipe downstream of said auxiliary throttle member and upstream of said main throttle member; and an air filter located in said chamber wherein air flowing through said chamber circulates across said filter.

2. The apparatus according to claim 1, wherein the auxiliary throttle member consists of an eccentrically mounted flap valve which the pressure differential across the flap valve tends to open against resilient return means.

3. The apparatus according to claim 1, wherein the auxiliary throttle member comprises a butterfly valve and a control member coupled to said butterfly valve and responsive to the pressure difference between a portion of said pipe upstream of the butterfly valve and a portion of said pipe situated downstream of the butterfly valve and upstream of said chamber.

4. The apparatus according to claim 1, wherein said filter is the main air filter of an engine.

5. A fuel feed apparatus for internal combustion engines, comprising: an intake pipe; main throttle means located in said intake pipe; auxiliary throttle means located in said intake pipe upstream of said main throttle means; means for progressively opening said auxiliary throttle means proportionally as the flow rate of air in said intake pipe increases; a source of fuel under pressure; a fuel supply circuit coupled to said fuel source and said intake pipe and opening into said pipe downstream of said main throttle means, said supply circuit including at least one solenoid valve for controlling the supply of fuel from said source into said pipe; a metering system coupled to said solenoid valve and to said auxiliary throttle means for providing energizing signals to said solenoid valve, the duration of said signals in a given time period varying proportionally with the amount of opening of said auxiliary throttle means; and means located in said intake pipe between said main and auxiliary throttle means for damping pulsations in the air flow through said intake pipe downstream of said auxiliary throttle means to provide a substantially uniform rate of air flow in said intake pipe downstream of said auxiliary throttle means.

* * * * *